US005994988A

United States Patent [19]

Ferree et al.

[11] Patent Number: 5,994,988

[45] Date of Patent: Nov. 30, 1999

[54] MOVABLE CONTACT STRUCTURE FOR A CIRCUIT BREAKER, INCLUDING CROSSBAR AND SPRING BIASED CAM MECHANISM

[75] Inventors: James E. Ferree, Lawrenceville; Bernard DiMarco, Lilburn; Robert E. Black, Snellville, all of Ga.

[73] Assignee: Siemens Energy & Automation, Inc., Alpharetta, Ga.

[21] Appl. No.: 08/988,093

[22] Filed: Dec. 10, 1997

Related U.S. Application Data

[63] Continuation-in-part of application No. 08/936,003, Sep. 23, 1997.

[51] Int. Cl.[6] ..... H01H 3/00; H01H 1/22

[52] U.S. Cl. ..... 335/190; 200/244; 335/192

[58] Field of Search ..... 200/17 R, 244, 200/254, 245, 288, 308, 312, 337, 401; 335/8–10, 16, 147, 185–195, 201; 218/1, 22, 143, 153, 154

[56] References Cited

U.S. PATENT DOCUMENTS

| | | | |
|---|---|---|---|
| 4,259,651 | 3/1981 | Yamat | 335/16 |
| 4,480,242 | 10/1984 | Castonguay et al. | 200/244 X |
| 4,488,133 | 12/1984 | McClellan et al. | 335/16 |
| 4,554,427 | 11/1985 | Flick | 200/250 |
| 4,594,567 | 6/1986 | DiMarco et al. | 335/16 |
| 4,611,187 | 9/1986 | Banfi | 335/16 |
| 4,638,277 | 1/1987 | Thomas et al. | 335/190 |
| 4,642,431 | 2/1987 | Tedesco et al. | 200/401 |
| 4,733,211 | 3/1988 | Castonguay et al. | 335/192 |
| 4,782,583 | 11/1988 | Castonguay et al. | 335/16 |
| 4,906,967 | 3/1990 | Winter | 335/172 |
| 4,931,603 | 6/1990 | Castonguay et al. | 278/1 |
| 5,004,878 | 4/1991 | Seymour et al. | 218/155 |
| 5,184,099 | 2/1993 | DiMarco et al. | 335/16 |
| 5,343,174 | 8/1994 | Turner et al. | 335/172 |
| 5,502,428 | 3/1996 | McColloch et al. | 335/172 |

*Primary Examiner*—J. R. Scott

[57] ABSTRACT

A circuit breaker (10) has a housing (12). A crossbar (114) is pivotally connected to the housing to pivot about an axis (117) between open and closed positions. A load contact arm (110) is pivotally connected to the crossbar (114). The load contact arm (110) is capable of pivoting about the axis (117). A cam mechanism (140) is mechanically coupled to the load contact arm (110). The cam mechanism (140) is slideably mounted within the crossbar (114) for movement between first and second positions. In the first position of the cam mechanism (140), the load contact arm (110) pivots through an angle (β) about the axis, relative to the crossbar (114) between the "touch" and closed positions, and the load contact arm (110) pivots together with the crossbar (114) through an angle (α) about the axis (117) between the open and "touch" positions. (2) In the second position of the cam mechanism (140), the load contact arm (110) is free to pivot about the axis (117) through the angle α to the open position while the crossbar (114) is in the closed position. A biasing spring (160) applies a biasing force to bias the cam mechanism (140) towards the first position.

30 Claims, 7 Drawing Sheets

MOVABLE CONTACT STRUCTURE FOR A CIRCUIT BREAKER, INCLUDING CROSSBAR AND SPRING BIASED CAM MECHANISM

This application is a continuation-in-part of co-pending U.S. Pat. application Ser. No. 08/936,003 entitled CIRCUIT BREAKER HAVING A CAM STRUCTURE WHICH AIDS BLOW OPEN OPERATION filed Sep. 23, 1997, which is hereby expressly incorporated in its entirety by reference.

BACKGROUND OF THE INVENTION

This invention relates to the contact operating mechanism of a circuit breaker and more particularly to a cam structure in that mechanism which improves blow-open performance of the contact arm of the circuit breaker during short circuit conditions.

The terms "blow open" or "blow off" are commonly used to describe a current interrupting mechanism which is used to handle very large short-circuit overcurrent conditions (e.g. when the current flow may be greater than 100 times the rated current of the breaker). The blow open mechanism causes the breaker contacts to open during the first millisecond that the overcurrent condition exists. This rapid operation is important to limit the current flow to a fraction of the available current and, therefore, to limit damage to the breaker and to apparatus connected to receive power through the circuit breaker.

The blow open force is a magnetic force which is generated by the large current flowing through a load contact arm (load blade) and a line contact arm (line strap) of the circuit breaker. To generate sufficient force to "blow open" the load and line contacts, the breaker is designed such that the load blade is in close proximity to and parallel to the line strap at least along part of its length. In addition, the currents flowing through the parallel portions of the load blade and the line strap are in opposite directions. This current flow produces opposing magnetic fields. Because the load blade and line strap are in close proximity, these opposing magnetic fields interact strongly, producing forces sufficient to blow the contacts apart more quickly than the current flow could be stopped by the instantaneous tripping function of the circuit breaker mechanism. When the contacts have been blown open, some current will continue to flow due to electrical arcs in the arc chamber and ionization of the air in the arc chamber. These currents plus the initial overcurrent condition, activate the trip mechanism of the breaker to ensure that the contacts do not reclose after they have been blown open.

The strength of the magnetic fields is a function of: 1) the amount of current flowing through the breaker, 2) the length of the parallel portions of the load blade and line strap and 3) the separation between the load blade and line contact. While this force can be made quite large by lengthening the parallel portions of the load blade and line strap, it may be difficult to implement a design of this type in the small space that is typically allowed for a circuit breaker. The blow-open force may also be increased by reducing the separation between the load blade and the line strap. This minimum separation, however, is limited by factors such as the need for strong electrical insulation between the load blade and line strap, the strength of the housing for the breaker and the ease with which the breaker may be assembled.

Another way in which the blow open force may be adjusted is to reduce the biasing force that holds the contacts closed during normal operation. If this force is reduced to too great an extent, however, the contacts may undesirably open during normal operation.

Some circuit breakers provide contact pressure by means of a plain spring-biasing the contact arm to the closed position. During blow open, the spring provides an opposing force that increases and is proportional to angle of opening of the contact arm. A problem with this structure is that the contact arm opens more slowly during a short circuit due to the higher opposing spring forces, and the contact arm is more likely to reclose before the electric current stops flowing.

A further conventional circuit breaker requires different amounts of force for normal opening and for a blow open condition. This capability is provided via a cam surface fixed to the crossbar, and a spring-biased pin that slides in a slot in the contact arm. A disadvantage of such a construction is that it requires a multi-piece crossbar because the cam needs to be metallic in order to resist wear. In other systems, this capability is provided by a cam surface on the edge of the contact arm. A spring-biased member acts against the cam-shaped edge of contact arm near the pivoting end. Such a structure typically requires a relatively large amount of space.

Still another conventional circuit breaker uses a spring, acting in compression, with one end hinged on a molded crossbar and the other end hinged on the contact arm. This creates a bi-stable toggle action. The disadvantages of this design, are (1) typically, the toggle mechanism is not compact because the spring must swing through a wide rotation angle relative to the crossbar, and (2) the toggle mechanism may cause a torque acting against the operating mechanism after a blow open event, reducing the force available to rotate the crossbar to the open position.

An improved circuit breaker is desired for quickly opening in a blow open condition, without occupying excessive space.

SUMMARY OF THE INVENTION

The present invention is embodied in a circuit breaker. The circuit breaker has a housing. A crossbar is pivotally connected to the housing to pivot between open and closed positions. A load contact arm is pivotally connected to the crossbar. The load contact arm is capable of pivoting about an axis. A cam mechanism is mechanically coupled to the load contact arm. The cam mechanism is slideably mounted within the crossbar for movement between:

(1) a first position of the cam mechanism in which the load contact arm pivots through a first angle about the axis, and the load contact arm pivots together with the crossbar to the open position, and (2) a second position of the cam mechanism in which the load contact arm is free to pivot about the axis to the open position while the crossbar is in the closed position.

A biasing mechanism applies a biasing force to bias the cam mechanism towards the first position.

OVERVIEW

Figure 1A:
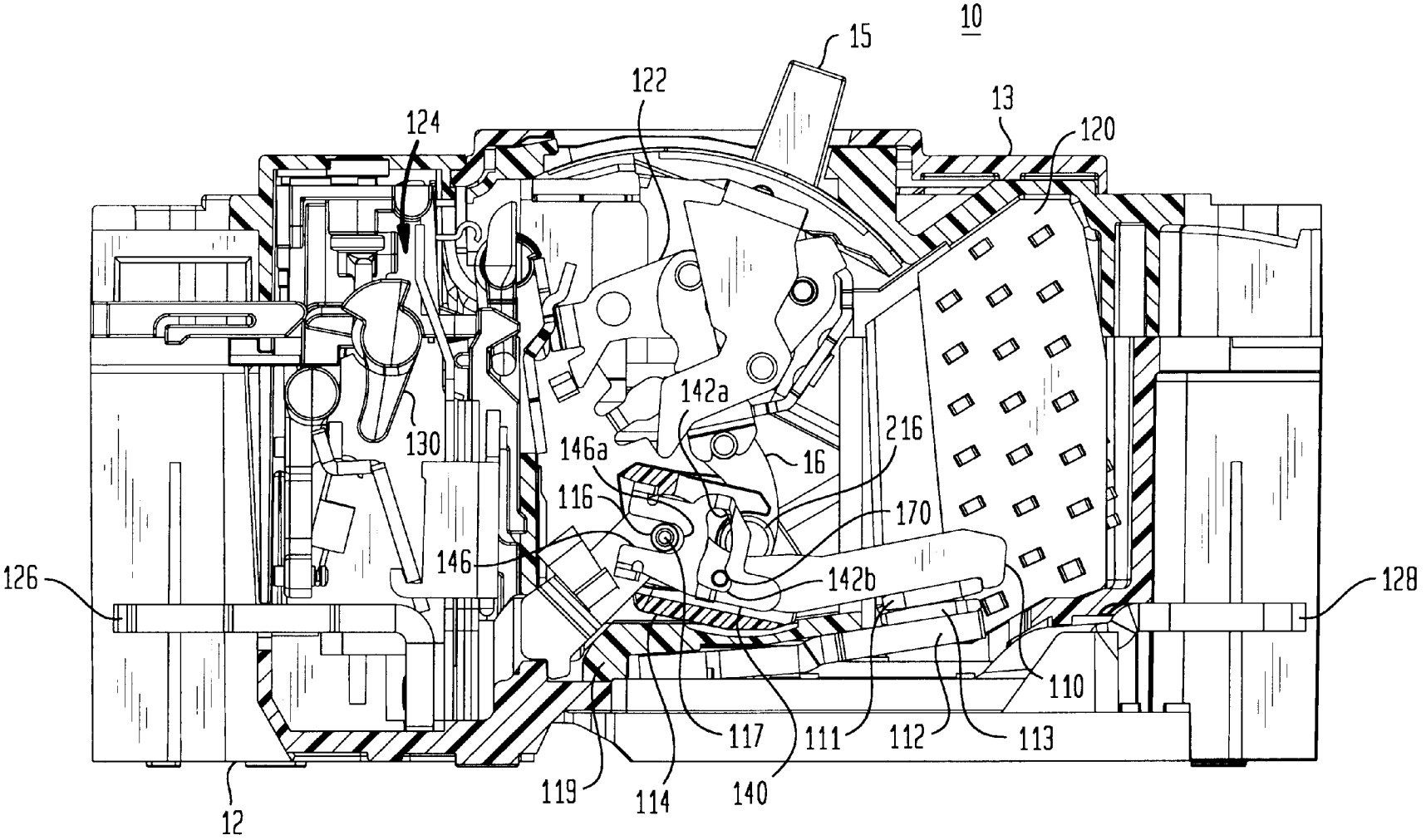
FIG. 1A is a cross sectional view of an exemplary circuit breaker according to the invention in the normal operating closed or "on" position.
Figure 1B:
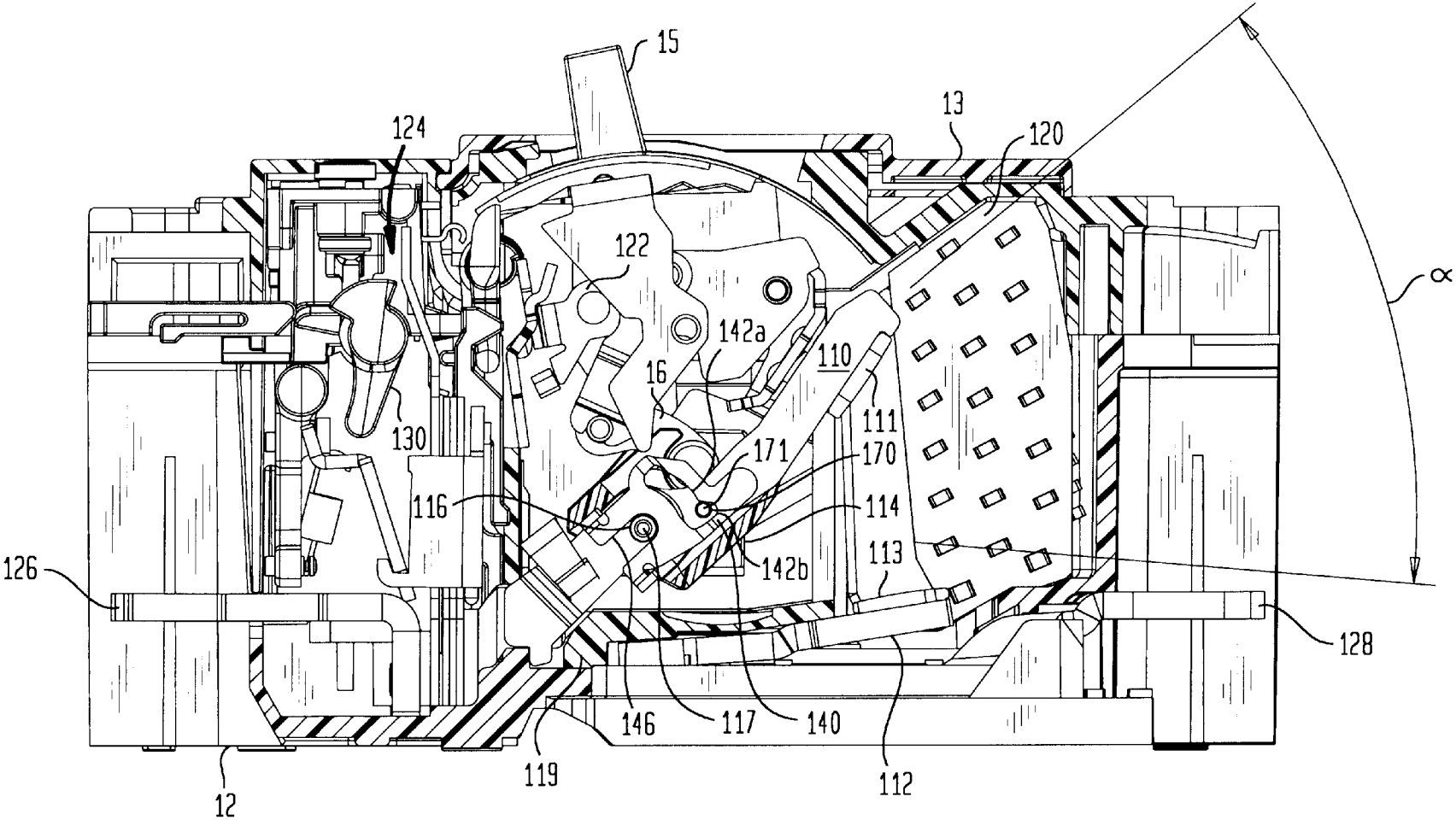
FIG. 1B is a cross sectional view of the circuit breaker of FIG. 1A, in the normal operating open or "off" position.
Figure 1C:
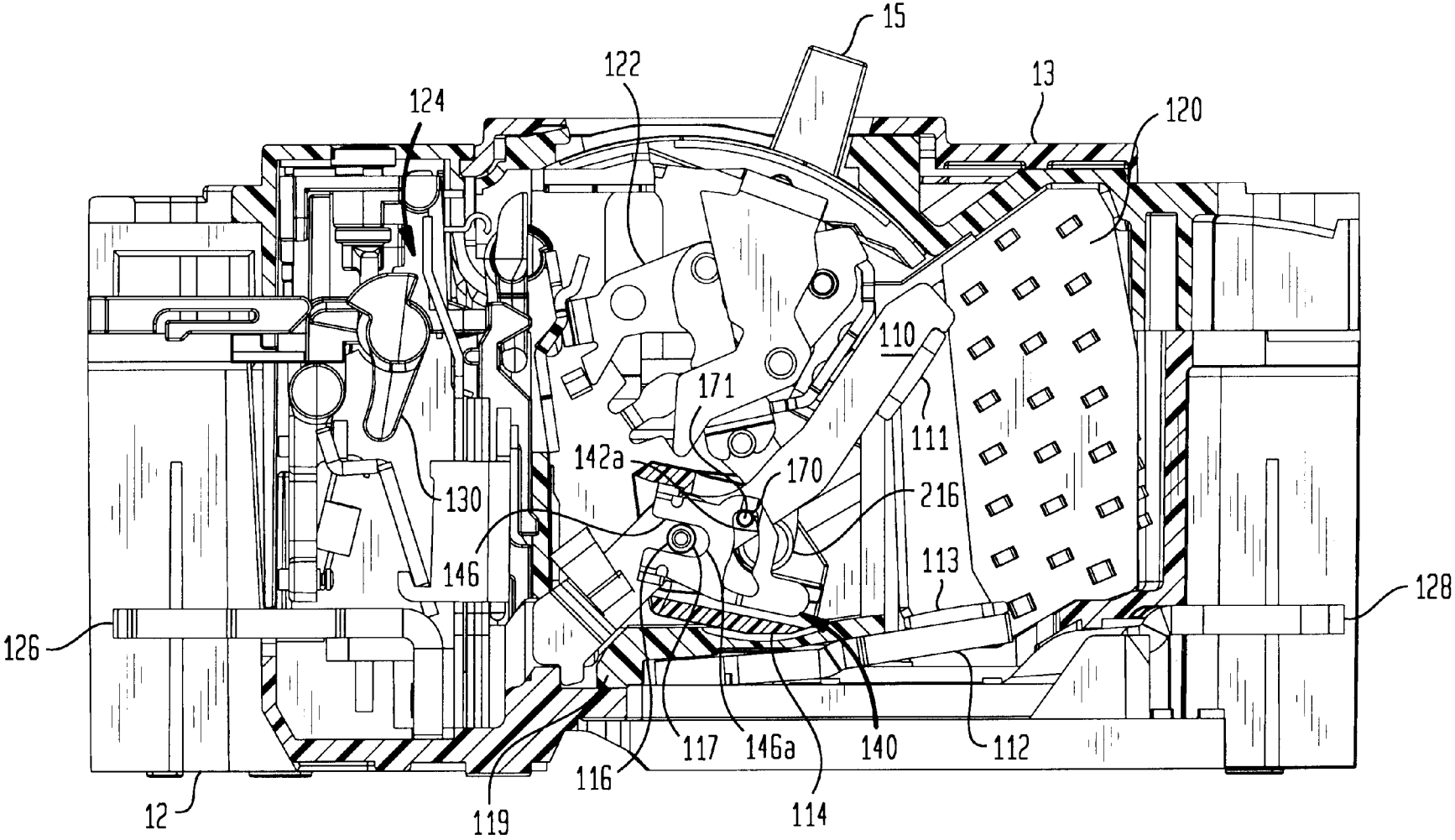
FIG. 1C is a cross sectional view of the circuit breaker of FIG. 1A, in a blown open condition.

FIGS. 1A to 1C show an exemplary circuit breaker 10 which has a housing base 12. A crossbar 114 is pivotally connected to the base 12 to pivot about an axis 117 between an open or "off" position shown in FIG. 1B and a closed or "on" position shown in FIG. 1A. The axis 117 passes through the center of a pivot pin 116. A load contact arm 110 is pivotally connected to the crossbar 114. The load contact arm 110 is capable of pivoting about the axis 117.

A cam mechanism is mechanically coupled to the load contact arm 110. The cam mechanism comprises a pair of cam structures 140 positioned within the crossbar 114. The load contact arm 110 is positioned between the cam structures 140. The cam mechanism is slideably mounted within the crossbar for movement between:

(1) a first position of the cam mechanism (shown in FIGS. 1A, 1B and 4), in which the load contact arm 110 pivots together with the crossbar 114 through an angle $\alpha$ (shown in FIG. 1B) about the axis 117 between the open and closed positions; and (2) a second position of the cam mechanism (shown in FIG. 1C), in which the load contact arm 110 is free to pivot about the axis 117 to the open position while the crossbar 114 is in the closed position.

Each cam structure 140 includes a cam pin slot 142 having a first slot portion 142*a* and a second slot portion 142*b* including positions 142*c* and 142*d*. The first slot portion 142*a* extends in an approximately tangential direction about the axis 117. The second slot portion 142*b* extends in a direction that is substantially different from the direction of the first slot portion 142*a*, and may be approximately 45 degrees from the direction of the first slot portion.

As described in detail below, the cam pin 170 is held at position 142*c* or 142*d* in the second slot portion 142*b* while the cam mechanism is in the first position (shown in FIGS. 1A, 1B and 4). The cam pin 170 moves freely within the first slot portion 142*a* while the cam mechanism is in the second position (best seen in FIG. 1C).

Figure 4:
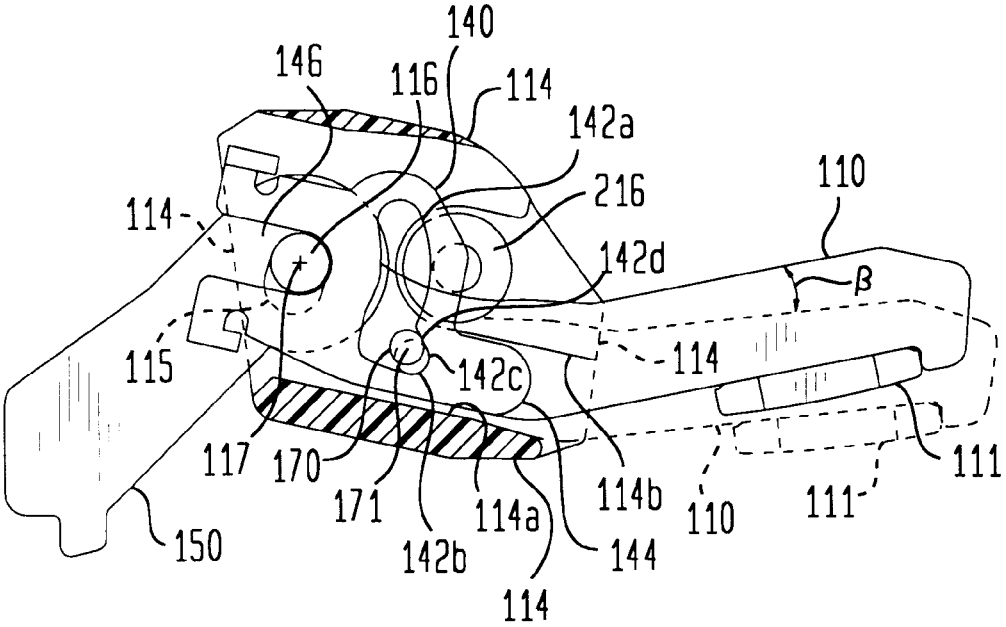
FIG. 4 is a cross sectional view taken along section line 4—4 of FIG. 2.
Figure 5:
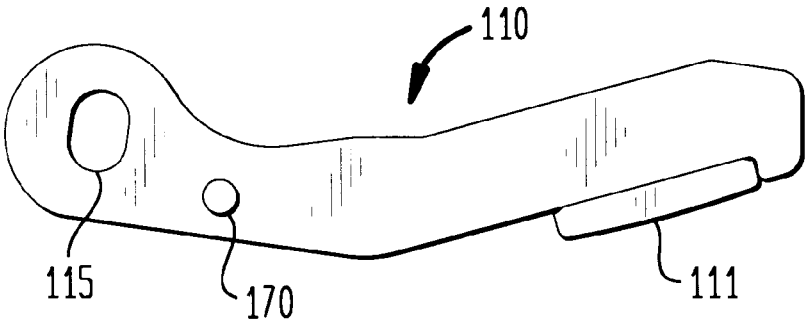
FIG. 5 is an elevation view of the load contact arm of FIG. 4.

The load contact arm 110 has an elongated pivot hole 115, best seen in FIG. 5. The elongated hole 115 has a dimension which is greater than the diameter of the pivot pin 116. When the crossbar is in the "touch" position, the load contact 111 and the line contact 113 begin to make contact and the pivot pin 116 is at the upper end of the elongated hole 115 and the cam pin 170 is at position 142*c* in portion 142*b* of the cam slot 142. As the crossbar continues to rotate to the fully "on" position, the cam pin 170 is forced to slide up the cam surface from position 142*c*, coming to rest at position 142*d*. This sliding action ensures that the load contact 111 is held against the line contact 113 by a compressive force when the breaker is in the closed position (as shown in FIGS. 1A and 4). As the contacts 111 and 113 wear, the position 142*d* moves closer to position 142*c*.

Each cam structure 140 has a pivot pin slot 146. The pivot pin 116 passes through the pivot pin slot 146, allowing the cam structure 140 to pivot around the pivot pin 116. The pivot pin slot 146 is elongated in a direction which allows the cam structure 140 to move between the first position (FIGS. 1A, 1B and 4) and the second position (FIG. 1C).

The crossbar assembly further comprises a pair of connectors 150 which electrically connect the load contact arm 110 to a trip unit 122 of the circuit breaker 10. The connectors 150 are mounted on the pivot pin 116 and retained in the base 12. The load contact arm 110 is positioned between the connectors 150.

The crossbar assembly further comprises a biasing means for applying a biasing force to bias the cam mechanism towards the first position (shown in FIGS. 1A, 1B and 4). The biasing means also applies an axial force to squeeze the cam structures 140 in the direction of the axis 117, to maintain electrical contact between the connectors 150 and the load contact arm 110.

The exemplary biasing means includes a respective torsion spring 160 for each cam structure. The springs are held in place by the pivot pin 116. Each torsion pin 160 has at least one end which engages a portion of a respective one of the cam structures 140, to bias the one cam structure towards the first position. In the exemplary embodiment, both ends of the torsion spring 160 engage a portion of the corresponding cam structure.

The invention provides a movable contact structure for a molded case circuit breaker including the following advantages: (1) providing a controlled contact force in the closed position, (2) providing "overtravel," that is, ensuring the load and line contacts are held together by compressive force when the breaker is in the closed position while allowing some erosion of the main contacts without excessive loss of contact force in the closed position, (3) allowing blow off of the contact arms, and (4) allowing a rocking action on the main contacts to facilitate opening of the contacts.

The invention provides a load contact which has two different levels of force for opening the circuit breaker 10. During normal operation, a relatively large force is exerted to maintain the contacts in a closed position. Once the cam shifts to its blown-open position (due to magnetic repulsive forces from a short circuit), a relatively small force is required to rotate the load contact arm further, so that the contacts can separate more rapidly into a fully open position.

Embodiments of the present invention may use a one-piece molded crossbar which reduces parts and assembly operations. The molded crossbar partially encloses the springs, and provides better protection from potential damage due to exposure to the arc than many prior art circuit breaker designs.

These and other advantages of the invention are readily recognizable in view of the detailed description of the exemplary embodiment, below.

DETAILED DESCRIPTION

Referring first to FIGS. 1A to 1C, an exemplary circuit breaker 10 according to the present invention includes an insulating support base 12, and cover 13. The main components of the breaker are a pivoting and movable upper contact arm or load blade 110, a stationary lower contact arm or line strap 112, arc chambers 120, an upper contact arm operating mechanism 122, a thermal and magnetic trip unit 124, a load terminal 126 and a line terminal 128. The circuit breaker 10 is a multi-phase device having one load blade 110, one line strap 112, one load terminal 126 and one line terminal 128 for each phase.

Load blade 110 has a conventional electrical contact 111 brazed or otherwise conductively fastened to a first end, and a pivot hole 115 at its second end. The load blade 110 is connected to the thermal and magnetic trip unit 124 via the connectors 150 (shown in FIG. 2). The trip unit 124, in turn, is connected to the load terminal 126. Electrical contact 111 engages and disengages from electrical contact. 113 which is brazed or otherwise conductively fastened to a first end of line strap 112. Line strap 112 has a "V" shape and the other end of the "V" is connected to the line terminal 128. The base 12 of the breaker 10 includes an insulating barrier 119 which separates the load blade 110 from a roughly parallel portion of the line strap 112.

Each load blade 110 is pivotally attached to a crossbar 114 by a pivot pin 116 which extends through the pivot hole 115 of the load blade 110. In normal operation, each load blade 110 is fixed in the crossbar 114 by a pair of cam structures 140. The crossbar 114 pivots on pivot bearings 216 (shown in FIG. 2) between open and closed positions (shown in FIGS. 1A and 1B, respectively). During a blow-open condition (shown in FIG. 1C), however, the crossbar 114 does not pivot immediately. Instead, the upward force on load blade 110 moves the cam pin 170 from position 142*c* or 142*d* of the cam slot 142 to portion 142*a*. Once the cam pin 170 is in portion 142*a*, the load blade 110 is freed to pivot about pivot pin 116 in order to break contact with the line contact 113. After the load contact 111 and line contact 113 have been blown open, the blow-open current and residual current flow causes the instantaneous trip mechanism of the breaker 10 to rotate the crossbar 114 in a counterclockwise position on the bearing 216, ensuring that the contacts 111 and 113 do not reclose. The operation of the load blade 110, cams 140, and crossbar 114 are described below with reference to FIGS. 2 through 6B.

In normal operation, the mechanism 122 rotates the crossbar 114 between closed position (FIG. 1A) and open position (FIG. 1B). When the operating mechanism 122 is in the closed position (FIG. 1A), it engages a spring-loaded latch which may be released by applying pressure to a trip bar 130. Because the load blades 110 are fixed to the crossbar 114 by the cam structures 140, the operating mechanism presses the load contacts 111 against the line contacts 113 when the breaker is in the closed position (FIG. 1A) and separates the contacts 111 and 113 when the breaker is in the open position (FIG. 1B). When the crossbar 114 is in its closed position and the trip unit 124 detects an overcurrent condition, trip unit 124 exerts pressure against the trip bar 130, releasing the latch and causing the breaker to open. While this trip mechanism is acceptable for relatively low-level faults, in relatively high-level fault conditions (e.g. greater than 100 times the breaker rating), it may not react with sufficient speed to prevent damage to the breaker 10 and to equipment or distribution lines attached to the load terminals 126. The blow-open mechanism of the present invention handles these high-level fault conditions.

As shown in FIG. 1A, the load blade 110 and line strap 112 are parallel along a portion of their length separated from each other by an insulator 119. In normal operation, the load blade 110 is fixedly attached to the cross bar assembly 114 by biasing forces which prevent the blade from becoming disengaged from the crossbar assembly 114.

Figure 2:
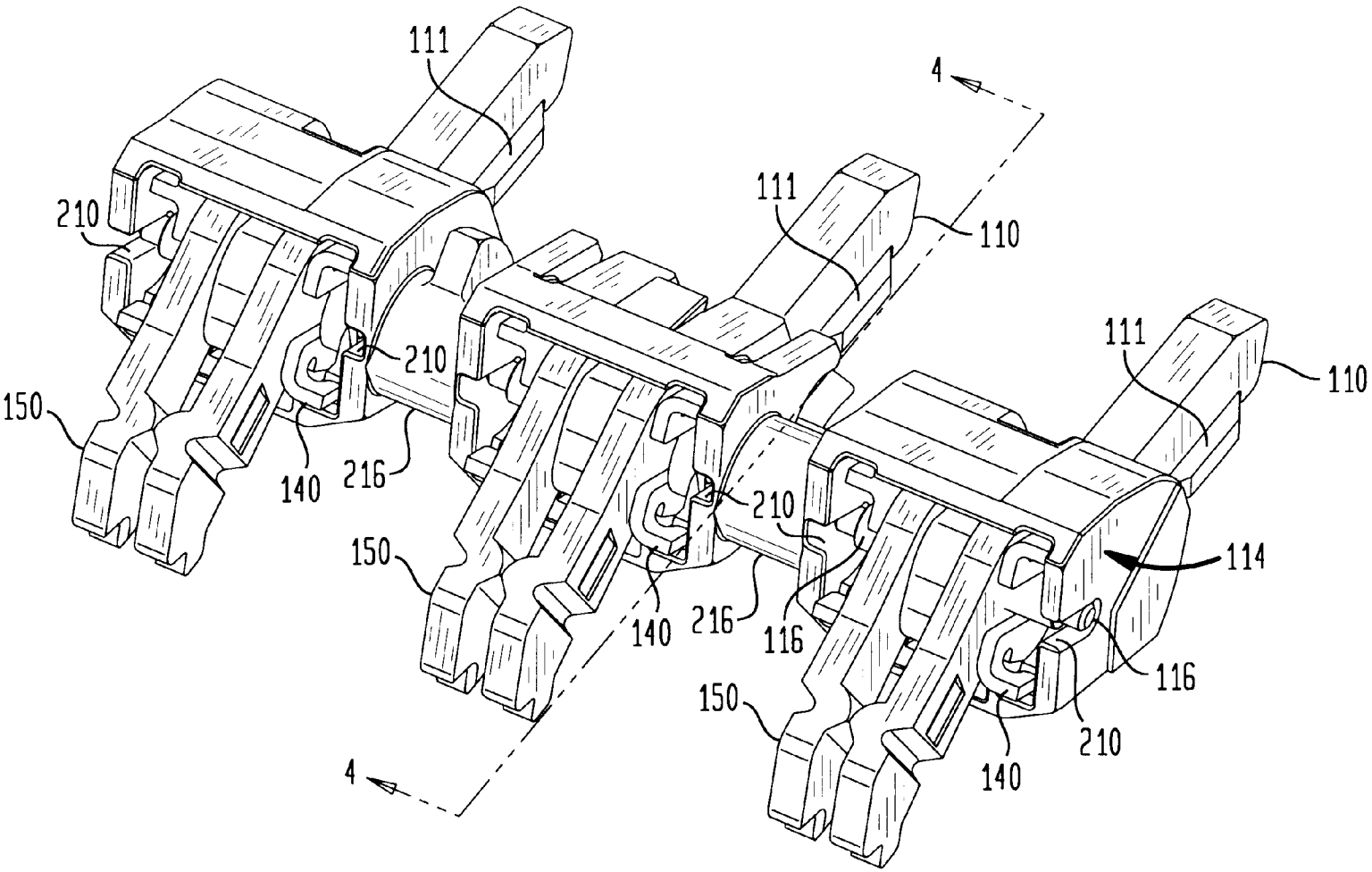
FIG. 2 is an isometric view of the circuit breaker cross bar assembly shown in FIG. 1A.

During large over current conditions, for example when the current flowing through the load blade 110 and line strap 112 may be greater than 100 times the rated current of the breaker, a relatively large repulsive magnetic force (proportional to the square of the current) is generated along the parallel lengths of the load blade 110 and line strap 112. This force is sufficient to disengage the load blade 10 from the crossbar mechanism 114 allowing it to break its contact with the line contact 113. FIG. 2 is an isometric drawing of a crossbar assembly 114 for a three pole breaker. Although the invention is described with reference to a three pole breaker, it is contemplated that it may be practiced in a single pole breaker or in other multi-pole breakers.

The structure shown in FIG. 2 includes the load blade 110 and cross bar 114. In addition it includes cams 140, springs 160 (shown in FIG. 3), pivot pin 116, and connectors 150. The combination of the cams 140, spring 160, pivot pin 116 and connectors 150 hold the load blade 110 in a relatively fixed position in the crossbar 114 during normal operation, while allowing a limited motion (while the cam pin moves between positions 142*c* and 142*d*) when the load contact arm 110 moves between the "touch" and "on" positions, as shown in FIG. 4. The configuration of FIG. 2 also allows the blade 110 to quickly rotate in a counterclockwise position relative to the crossbar assembly 114 during a blow-off condition.

Each pole of the crossbar assembly 114 includes a notch 210 into which the pivot pin 116 is inserted. The pivot pin 116 extends through the pivot hole 115 in the load blade 110 and a pivot pin slot 146 in cam structures 140. The load blade 110 pivots only slightly about the pivot pin 116 during normal operation. As described above, when moving between the "touch" and "on" positions, load blade 110 pivots about pivot pin 116, through a small angle β between a "touch" position (shown in phantom in FIG. 4) and an "on" position (shown by solid lines in FIG. 4) while the cam pin 170 moves from position 146*c* to position 146*d*. In the "on" position, the cam 140 ensures that the load contact 111 is held against the line contact 113 (shown in FIG. 1A) with compressive force.

Figure 3:
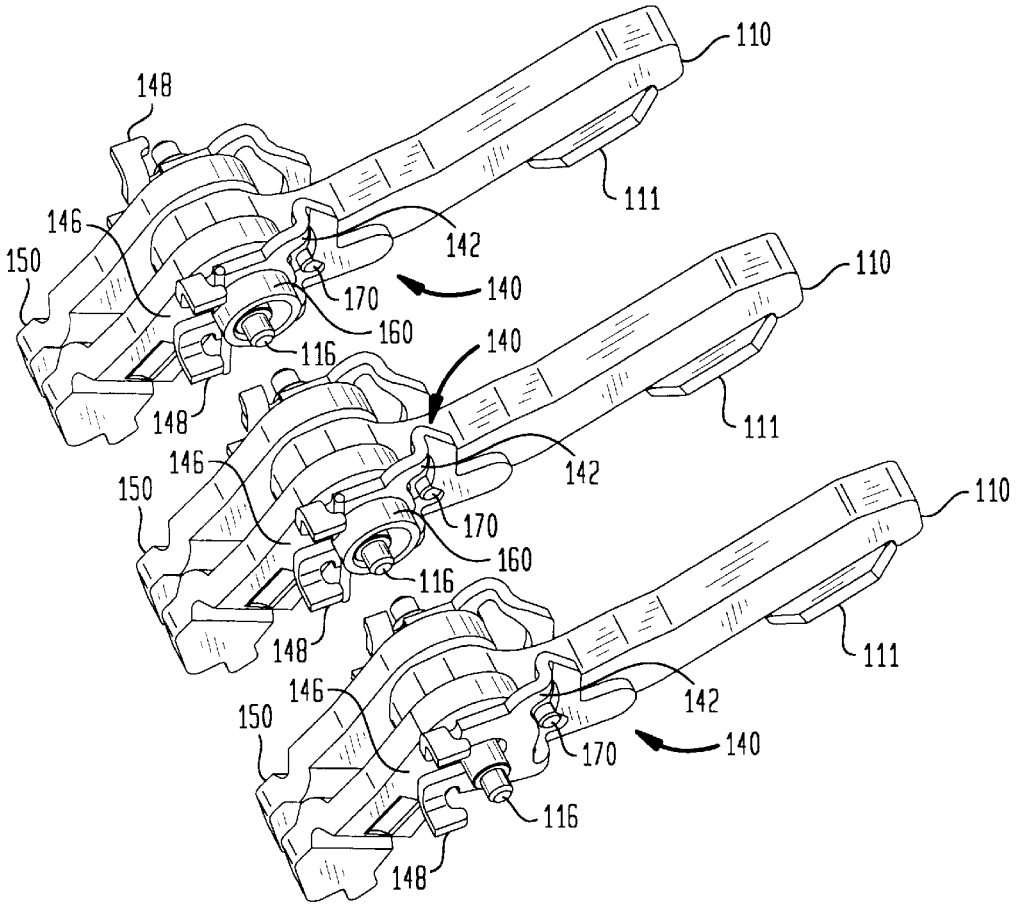
FIG. 3 is an isometric view of the contact arm assembly within the cross bar assembly of FIG. 2.

FIG. 3 shows the load contact arm assemblies without the crossbar 114. Each load contact arm 110 is sandwiched between a pair of connectors 150. The connectors are, in turn, sandwiched between a pair of cam structures 140. A pivot pin 116 passes through each cam-connector-load arm-connector-cam combination to form an assembly which is inserted into a slot in the crossbar 114.

A torsion spring 160 is placed over each end of each pivot pin 116. Although FIG. 3 only shows two springs 160, one of ordinary skill recognizes that there are four additional springs 116 (not shown in FIG. 4), one on each of the remaining four cam structures 140. The spring 160 is held in compression between the pivot pin 116 on one end and the cam structures 140 on the other end. Spring 160 has two functions. First, the spring 160 exerts a bias force which tends to push each cam structure 140 towards the left of the figure, away from the contact end 111 of its respective load contact arm 110. This force biases each cam 140 towards a first position in which the cam pin 170 engages the foot portion 142*b* of slot 142. In this first position, load blade 110 is locked into the crossbar assembly except that the load blade 110 pivots about the axis 117 which passes through the pivot pin 116 between the "touch" and "on" positions. As noted above, the range of the pivot motion between the "touch" and "on" positions is limited to an angle β which decreases as the contacts 111 and 113 wear. Second, during normal operation, the spring 160 holds the connectors 150 against the load contact arm 110.

The forces exerted on load contact arm 110 in normal operation are insufficient to overcome the bias force of torsion springs 160. Thus, in the "on" position, cam pin 170 normally remains seated at position 142*d* of the cam pin slot 142.

During a blow off condition, the magnetic forces acting on load contact arm 110 are sufficient to overcome the biasing force of the torsion springs 160. The cam 140 is pushed to the right (as shown in FIG. 1C) by the blow off force, as exerted at point 142*d* of the cam pin slot 142 by the cam pin 170. This causes the cam 140 to move towards the contact 111 of load contact arm 110, so that the end of cam slot 146*a* partially withdraws from being seated against the pivot pin 116. This partially withdrawn position of the cam 140 is also referred to herein as the "second position." As the cam 140 moves toward the load contact 111, the cam pin 170 moves from the position 142*d,* in cam slot portion 142*b* (also referred to herein as the second portion of the cam pin slot), to the tangential portion 142*a* of the cam pin slot (also referred to herein as the first portion of the cam pin slot), allowing the blade 110 to rotate in a counterclockwise direction away from the line strap 112.

In a variation of the exemplary embodiment, one end of each torsion spring 160 may apply a force against the crossbar 114. This would provide the advantage of helping to retain the pivot pin 116 in the crossbar.

In the exemplary embodiment, both ends of torsion spring 160 act against the cam 140, because this provides twice as much biasing force on the cam 140 and allows use of a smaller spring. A secondary function of the torsion springs is that they bias the crossbar cams in a manner that tends to squeeze the connectors 150 together against the load contact arm 110. This provides some or all of the force needed to maintain a good electrical contact between the connectors 150 and the load blade 110.

The connectors 150 provide a conducting path to the pivoting end of the load contact arm 110. An additional function of the connectors 150 is to provide a removable plug-in connection for the trip unit 124. In a variation of the exemplary embodiment, this electrical connection could be provided by brazing or welding a flexible copper braid to the load contact arm 110. However, an advantage of the connectors 150 in the exemplary embodiment is that the additional plug-in function may be accomplished with fewer parts and manufacturing steps than a brazed or welded joint would require.

FIG. 4 is a cross sectional view showing the crossbar 114, load contact arm 110, cam 140, cam pin 170, pivot pin 116, and connector 150. FIG. 4 shows how the present invention allows the load contact arm 110 to pivot between the "touch" position (shown in phantom) and the "on" position shown in solid lines.

During normal usage, as the crossbar 114 is rotated clockwise from the open position, load contact arm 110 is in the rest position, with the bottom of load contact arm 110 resting on surface 114*a* of crossbar 114. In the rest position, the bottom of pivot hole 115 abuts pivot pin 116 (not shown). Load contact arm 110 remains in the rest position until load contact 111 contacts line strap contact 113. As crossbar 114 continues to rotate clockwise, load contact arm 110 pivots in a counter-clockwise direction about cam pin 170 until the top of pivot hole 115 abuts pivot pin 116. At this point, the breaker is in "touch" position, as shown in phantom in FIG. 4. As the crossbar continues to its fully closed position, the cam pin 170 is forced to slide up the cam surface from position 142*c,* coming to rest at position 142*d.* When the cam pin 170 is at position 142*d,* the load contact 111 and line contact 113 are held together with compressive force. These features ensure that a good electrical contact is made, even if the contacts 111 and 113 wear with use. This configuration is also advantageous when opening the breaker 10.

A receptacle 216 is provided for receiving a linkage 16 (shown in FIG. 1A) that is attached to a toggle switch 15 (shown in FIG. 1A). When a user toggles the switch 15, the linkage transfers the motion of the switch 15 to crossbar 114.

The crossbar 114 constrains the cams 140. The cams 140 are allowed to move in a left to right direction, but not up or down. On the left side, cam 140 is held by pivot pin 116. Cam 140 is also held on the right side by a finger 144. Finger 144 is limited to left-right motion by the cross bar 114. Finger 144 fits into a groove 114*b* in crossbar 114, to further limit cam 140 to left-right motion.

The crossbar 114 transfers force from the operating mechanism to the load contact arms 110, and converts the motion of the mechanism to a rotary motion of the load contact arms. The crossbar 114 may be a molded plastic part that insulates the conductors 110 from each other phase-to-phase.

FIG. 5 is a drawing of the load contact arm 110. As shown in FIG. 4, the load blade 110 includes an oval or elongated pivot hole 115 through which a round pivot pin 116 (FIG. 3) is inserted to attach the load blade 110 to the cross bar assembly. The cam pin 170 is firmly attached to the load contact arm, for example, by a press fit or by brazing.

Figure 6A:
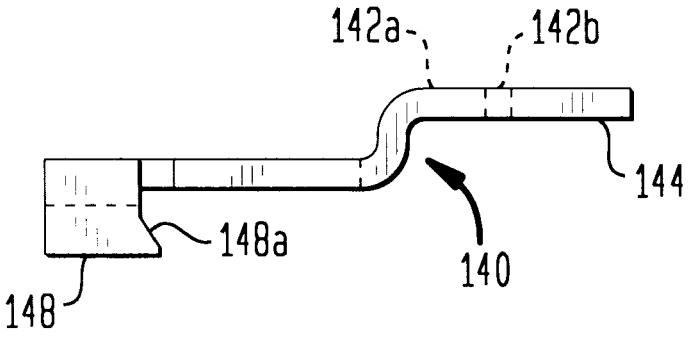
FIGS. 6A and 6B are plan and elevation views, respectively, of the crossbar cam shown in FIG. 4.
Figure 6B:
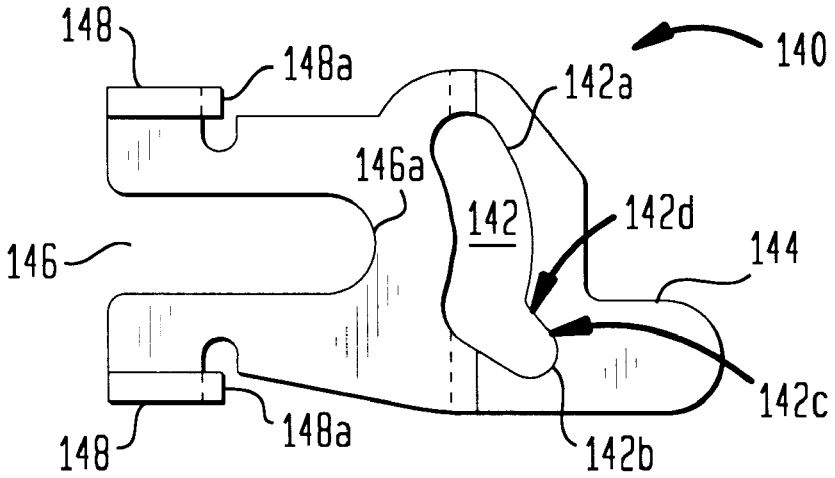

FIGS. 6A and 6B show the cam structure 140 in greater detail. As shown in FIG. 6A, cam 140 is generally S-shaped, with the left portion and the right portion being offset from each other. The offset allows the left side of cam 140 to abut connector 150, while the right side of cam 140 abuts load contact arm 110. Cams 140 also include foot-shaped projections 148. Each projection 148 has a spur 148*a* for retaining a respective end of torsion spring 160, as best seen in FIG. 3.

Although the invention has been described with reference to exemplary embodiments, it is not limited thereto. Rather, the appended claims should be construed to include other variants and embodiments of the invention which may be made by those skilled in the art without departing from the scope of the present invention.

What is claimed:

1. A circuit breaker comprising:

a housing;

a crossbar pivotally connected to the housing to pivot about an axis between open and closed positions;

a load contact arm pivotally connected to the crossbar, the load contact arm being capable of pivoting about the axis;

a cam mechanism, mechanically coupled to the load contact arm, the cam mechanism being slideably mounted within the crossbar for movement between:

(1) a first position of the cam mechanism in which the load contact arm pivots together with the crossbar through an angle about the axis to the open position, and (2) a second position of the cam mechanism in which the load contact arm is free to pivot about the axis to the open position while the crossbar is in the closed position; and biasing means for applying a biasing force to bias the cam mechanism towards the first position.

2. A circuit breaker according to claim 1, wherein:

the load contact arm includes a cam pin which engages the cam; and the cam includes a cam surface having first and second positions, the cam pin being in the first position on the cam surface as the load contact arm makes contact with a line contact arm and the cam pin moving to the second position on the cam surface as the crossbar moves to the closed position.

3. A circuit breaker according to claim 2, wherein the cam mechanism comprises a pair of cam structures positioned within the crossbar, the load contact arm being positioned between the cam structures.

4. A circuit breaker according to claim 3, wherein the biasing means includes first and second torsion springs held in compression by the pair of cam structures, wherein the torsion springs exert a compressive force which tends to push the cams toward the load contact arm.

5. A circuit breaker according to claim 2, wherein each cam structure includes:

a cam pin slot having first and second slot portions connected to each other, the first slot portion extending in an approximately tangential direction about the axis, the second slot portion extending in a direction that is substantially different from the direction of the first slot portion, and the second slot portion including the cam surface and the first and second cam surface positions, wherein the cam pin is held in the second slot portion and moves between the first and second cam surface positions while the cam mechanism is in the first position, and the cam pin moves freely within the first slot portion while the cam mechanism is in the second position.

6. A circuit breaker according to claim 5, wherein the direction of the second slot portion is approximately 45 degrees from the direction of the first slot portion.

7. A circuit breaker according to claim 4, further comprising a pivot pin, the axis passing through the pivot pin, wherein each cam structure has a pivot pin slot, the pivot pin passing through the pivot pin slot allowing the cam structure to pivot around as the pivot pin, the pivot pin slot being elongated in a direction which allows the cam structure to move between the first and second positions.

8. A circuit breaker according to claim 7, further comprising a pair of connectors for electrically connecting the load contact arm to a main contact of the circuit breaker, the connectors being coupled to the load contact arm by the pivot pin, wherein the load contact arm is positioned between the connectors.

9. by A circuit breaker according to claim 8, wherein the biasing means applies a force to the cam structures in the direction of the axis, to maintain electrical contact between the connectors and the load contact arm.

10. A circuit breaker according to claim 9, wherein the biasing means include a pair of torsion springs, each torsion spring being held in place by the pivot pin, each torsion spring having at least one end which engages a portion of a respective one of the cam structures to bias the one cam structure towards the first position.

11. A circuit breaker comprising:

a housing;

a crossbar pivotally connected to the housing to pivot about an axis between open and closed positions;

a pivot pin having a diameter, the axis passing through the pivot pin;

a load contact arm pivotally connected to the crossbar, the load contact arm being capable of pivoting about the axis, the load contact arm including a cam pin attached thereto;

a cam mechanism, mechanically coupled to the load contact arm, the cam mechanism being slideably mounted within the crossbar for movement between:

(1) a first position of the cam mechanism in which the load contact arm pivots through a first angle about the axis relative to the crossbar as the load contact arm is moved from a touch position to a closed position, and the load contact arm pivots together with the crossbar through a second angle about the axis to the open position, the dimension of the elongated hole determining the second angle, and (2) a second position of the cam mechanism in which the load contact arm is free to pivot about the axis to the open position while the crossbar is in the closed position, the cam mechanism including a pair of cam structures positioned within the crossbar, the load contact arm being positioned between the cam structures, each cam structure including a cam pin slot having first and second slot portions connected to each other, the first slot portion extending in an approximately tangential direction about the axis, the second slot portion extending in a direction that is substantially different from the direction of the first slot portion, wherein the cam pin is held in the second slot portion while the cam mechanism is in the first position, and the cam pin moves within the second slot portion, and the cam pin moves freely within the first slot portion while the cam mechanism is in the second position; and biasing means for applying a biasing force to bias the cam mechanism towards the first position.

12. A circuit breaker according to claim 11, wherein:

the second portion of each cam slot includes a cam surface having first and second positions, the cam pin being in the first position on the cam surface as the load contact arm makes contact with a line contact arm and the cam pin moving to the second position on the cam surface as the crossbar moves to the closed position.

13. A circuit breaker according to claim 12, further comprising a pair of connectors for electrically connecting the load contact arm to a main contact of the circuit breaker, the connectors being coupled to the load contact arm by the pivot pin, wherein the load contact arm is positioned between the connectors and the combination of the load contact arm and the connectors is positioned between the cams.

14. A circuit breaker according to claim 13, wherein the biasing means applies a force to the cam structures in the direction of the axis, to maintain electrical contact between the connectors and the load contact arm.

15. A circuit breaker according to claim 14, wherein the biasing means include a pair of torsion springs, each torsion spring being held in place by the pivot pin, each torsion spring having at least one end which engages a portion of a respective one of the cam structures to bias the one cam structure towards the first position.

16. A circuit breaker comprising:

a housing;

a crossbar pivotally connected to the housing to pivot about an axis between open and closed positions;

a load contact arm pivotally connected to the crossbar, the load contact arm being capable of pivoting about the axis;

a cam mechanism, mechanically coupled to the load contact arm, the cam mechanism being slideably mounted within the crossbar for movement between:

(1) a first position of the cam mechanism in which the load contact arm pivots together with the crossbar through an angle about the axis to the open position, and (2) a second position of the cam mechanism in which the load contact arm is free to pivot about the axis to the open position while the crossbar is in the closed position; and a biasing spring, mounted within the crossbar and having first and second ends which are mechanically coupled to the cam mechanism to bias the cam mechanism towards the first position.

17. A circuit breaker according to claim 16, wherein:

the load contact arm includes a cam pin which engages the cam; and the cam includes a cam surface having first and second positions, the cam pin being in the first position on the cam surface as the load contact arm makes contact with a line contact arm and the cam pin moving to the second position on the cam surface as the crossbar moves to the closed position.

18. A circuit breaker according to claim 17, wherein the cam mechanism comprises a pair of cam structures positioned within the crossbar, the load contact arm being positioned between the cam structures.

19. A circuit breaker according to claim 18, wherein the biasing spring includes first and second torsion springs held in compression by the pair of cam structures, wherein the torsion springs exert a compressive force which tends to push the cams toward the load contact arm.

20. A circuit breaker according to claim 17, wherein each cam structure includes:

a cam pin slot having first and second slot portions connected to each other, the first slot portion extending in an approximately tangential direction about the axis, the second slot portion extending in a direction that is substantially different from the direction of the first slot portion, and the second slot portion including the cam surface and the first and second cam surface positions, wherein the cam pin is held in the second slot portion and moves between the first and second cam surface positions while the cam mechanism is in the first position, and the cam pin moves freely within the first slot portion while the cam mechanism is in the second position.

21. A circuit breaker according to claim 20, wherein the direction of the second slot portion is approximately 45 degrees from the direction of the first slot portion.

22. A circuit breaker according to claim 19, further comprising a pivot pin, the axis passing through the pivot pin, wherein each cam structure has a pivot pin slot, the pivot pin passing through the pivot pin slot allowing the cam structure to pivot around the pivot pin, the pivot pin slot being elongated in a direction which allows the load cam structure to move between the first and second positions.

23. A circuit breaker according to claim 22, further comprising a pair of connectors for electrically connecting the load contact arm to a main contact of the circuit breaker, the connectors being coupled to the load contact arm by the pivot pin, wherein the load contact arm is positioned between the connectors.

24. A circuit breaker according to claim 23, wherein the first and second torsion springs each apply a force to a respective one of the cam structures in opposite directions along the axis, to maintain electrical contact between the connectors and the load contact arm.

25. A circuit breaker according to claim 24, wherein the biasing spring include a pair of torsion springs, each torsion spring being held in place by the pivot pin, each torsion spring having at least one end which engages a portion of a respective one of the cam structures to bias the one cam structure towards the first position.

26. A circuit breaker comprising:

a housing;

a crossbar pivotally connected to the housing to pivot about an axis between open and closed positions;

a pivot pin having a diameter, the axis passing through the pivot pin;

a load contact arm pivotally connected to the crossbar, the load contact arm being capable of pivoting about the axis, the load contact arm including a cam pin attached thereto;

a cam mechanism, mechanically coupled to the load contact arm, the cam mechanism being slideably mounted within the crossbar for movement between:

(1) a first position of the cam mechanism in which the load contact arm pivots through a first angle about the axis relative to the crossbar as the load contact arm is moved from a touch position to a closed position, and the load contact arm pivots together with the crossbar through a second angle about the axis to the open position, the dimension of the elongated hole determining the second angle, and (2) a second position of the cam mechanism in which the load contact arm is free to pivot about the axis to the open position while the crossbar is in the closed position, the cam mechanism including a pair of cam structures positioned within the crossbar, the load contact arm being positioned between the cam structures, each cam structure including a cam pin slot having first and second slot portions connected to each other, the first slot portion extending in an approximately tangential direction about the axis, the second slot portion extending in a direction that is substantially different from the direction of the first slot portion, wherein the cam pin is held in the second slot portion while the cam mechanism is in the first position, and the cam pin moves within the second slot portion, and the cam pin moves freely within the first slot portion while the cam mechanism is in the second position; and first and second torsion springs, each mounted within the crossbar each of torsion springs being held in compression by a respective one of the pair of cam structures to bias the respective cam structure towards the first position.

27. A circuit breaker according to claim 26, wherein:

the second portion of each cam slot includes a cam surface having first and second positions, the cam pin being in the first position on the cam surface as the load contact arm makes contact with a line contact arm and the cam pin moving to the second position on the cam surface as the crossbar moves to the closed position.

28. A circuit breaker according to claim 27, further comprising a pair of connectors for electrically connecting the load contact arm to a main contact of the circuit breaker, the connectors being coupled to the load contact arm by the pivot pin, wherein the load contact arm is positioned between the connectors and the combination of the load contact arm and the connectors is positioned between the cams.

29. A circuit breaker according to claim 28, wherein the first and second torsion springs each applies a force to the respective one of the cam structures in opposite directions along the axis, to maintain electrical contact between the connectors and the load contact arm.

30. A circuit breaker according to claim 29, wherein the first and second torsion springs, are held in place by the pivot pin, each torsion spring having at least one end which engages a portion of a respective one of the cam structures to bias the one cam structure towards the first position.

* * * * *